US008772659B2

(12) United States Patent
Iwamoto

(10) Patent No.: US 8,772,659 B2
(45) Date of Patent: Jul. 8, 2014

(54) ELECTRONIC APPARATUS

(75) Inventor: Akira Iwamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 162 days.

(21) Appl. No.: 13/351,817

(22) Filed: Jan. 17, 2012

(65) Prior Publication Data

US 2012/0181155 A1 Jul. 19, 2012

(30) Foreign Application Priority Data

Jan. 17, 2011 (JP) ..... 2011-007114
Mar. 8, 2011 (JP) ..... 2011-050421

(51) Int. Cl.
*H01H 3/12* (2006.01)
*H01H 13/14* (2006.01)
*H01H 13/84* (2006.01)

(52) U.S. Cl.
CPC ..... *H01H 13/84* (2013.01); *H01H 3/125* (2013.01); *H01H 2221/062* (2013.01); *H01H 2217/044* (2013.01); *H01H 2215/006* (2013.01); *H01H 2227/022* (2013.01); *H01H 2215/004* (2013.01)
USPC ..... 200/341

(58) Field of Classification Search
USPC ..... 200/310, 5 A, 5 R, 511–512, 520, 521, 200/308, 311, 313, 314, 317, 337, 341, 343, 200/345, 292, 329
See application file for complete search history.

(56) References Cited

U.S. PATENT DOCUMENTS

| | | | | |
|---|---|---|---|---|
| 5,718,327 | A * | 2/1998 | Wu | 200/344 |
| 7,525,056 | B2 * | 4/2009 | Chiba et al. | 200/314 |
| 2005/0000789 | A1 * | 1/2005 | Yoneyama | 200/512 |
| 2006/0006052 | A1 * | 1/2006 | Takahashi | 200/5 A |
| 2009/0128496 | A1 * | 5/2009 | Huang et al. | 345/170 |

FOREIGN PATENT DOCUMENTS

| | | |
|---|---|---|
| JP | 08-083532 | 3/1996 |
| JP | 2001-184979 | 7/2001 |
| JP | 2002-334629 | 11/2002 |
| JP | 2009-059716 | 3/2009 |
| JP | 2010-267494 | 11/2010 |

* cited by examiner

*Primary Examiner* — R S Luebke
*Assistant Examiner* — Anthony R. Jimenez
(74) *Attorney, Agent, or Firm* — Hamre, Schumann, Mueller & Larson, P.C.

(57) ABSTRACT

Key impact noise produced during data entry operations is abated with a configuration in which the deformable portion of the resilient member can abut the bottom surface of the key top and a gap is formed between the key top and the membrane sheet when the key top is displaced to the lowered position. This allows for the key top to be prevented from abutting the membrane sheet when the key top is displaced by the user from the raised position to the lowered position. As a result, the noise of collision between the key top and the membrane sheet is no longer produced and the key impact noise of the keyboard can be diminished.

4 Claims, 14 Drawing Sheets

ELECTRONIC APPARATUS

BACKGROUND OF THE INVENTION

1. Field of the Invention

This application relates to an electronic apparatus.

2. Description of Related Art

A keyboard mounted or connected to a personal computer (referred to as a "PC" below) is equipped with multiple strokable key tops.

Patent Document 1 (JP2001-184979A) has disclosed a configuration where, in a membrane switch sheet arranged underneath a guide member guiding the vertical motion of a key top in a region that corresponds to the lower edges of the key top while having a width greater than the width of the lower edges of the key top, a space is formed between the bottom surface of an upper switching sheet and the top surface of a lower switching sheet, with dot spacers interposed therebetween.

According to the disclosure of Patent Document 1, when the lower edges of the key top collide with the top surface of the upper sheet of the membrane switch sheet upon depression of the key top, the impact due to the collision between the lower edges of the key top and the upper sheet is alleviated by the space formed between the upper sheet and lower sheet, thereby allowing for the collision noise to be dampened.

However, since the configuration disclosed in Patent Document 1 is still a configuration in which the lower edges of the key top collide with the top surface of the upper switching sheet of the membrane switch sheet upon depression of the key top, the effect of reduction in key impact noise produced during data entry operations is limited and it may prove impossible to abate the key impact noise sufficiently.

SUMMARY OF THE INVENTION

The electronic apparatus of this application comprises: a key top; a lifting/lowering mechanism supporting the key top for free up-and-down motion between a raised position and a lowered position; a contact portion that effects switching in conjunction with the up-and-down action of the key top; a resilient member that, along with being capable of causing the key top to remain on standby in the raised position, can be deformed resiliently during the downward travel of the key top; and a substrate that, along with supporting the lifting/lowering mechanism, has the resilient member arranged thereon, with the resilient member comprising: an abutting portion that abuts the underside of the operative surface of the key top; an affixed portion affixed to the substrate; and a deformable portion provided between the abutting portion and the affixed portion, and the deformable portion undergoing resilient deformation to permit abutment against the underside of the key top when the key top is in the lowered position.

The disclosure of this application makes it possible to abate the key impact noise produced during data entry operations.

DETAILED DESCRIPTION OF THE INVENTION

Embodiment 1

1. Configuration of the Electronic Apparatus

Figure 1:
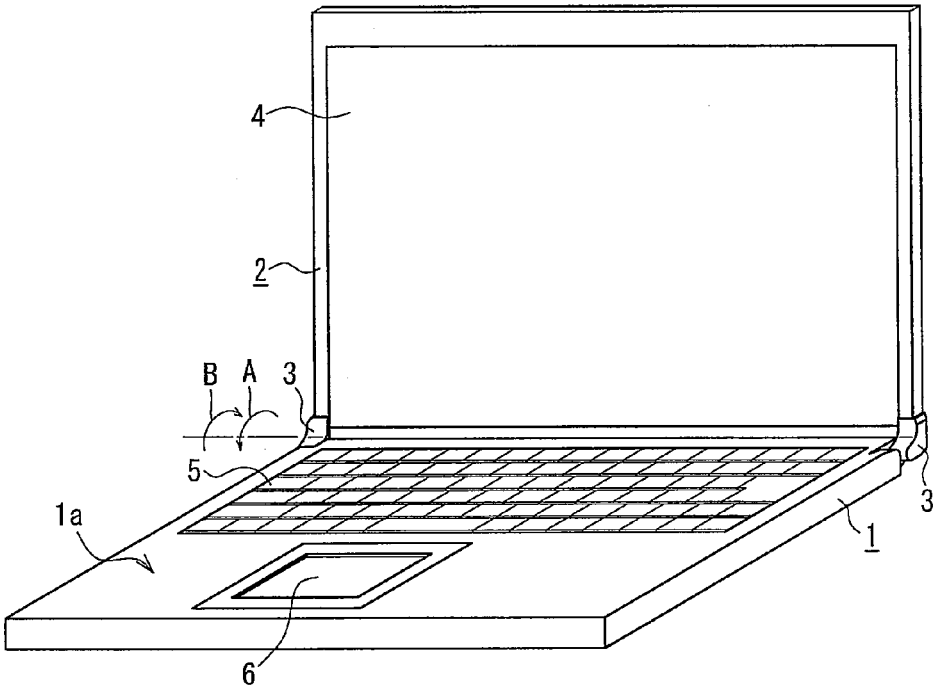
FIG. 1 is an oblique view of a notebook PC.

FIG. 1 is an oblique view illustrating the external appearance of a notebook PC used in this embodiment. It should be noted that while a notebook PC is used as an exemplary electronic apparatus in this embodiment, any apparatus can be employed as long as the apparatus is provided with at least an input device, such as a keyboard. In addition, while the keyboard of a notebook PC is used as an exemplary input device, the device may be the keyboard of an input device connectable to a desktop PC, a PDA (personal digital assistant), and the like. Further, in addition to keyboards with a QUERTY layout, the keyboard used in this embodiment includes, for example, keyboards that can be used only for entering numbers, arithmetic symbols, and the like.

As shown in FIG. 1, the notebook PC comprises a first enclosure 1 and a second enclosure 2. The first enclosure 1 houses a hard disk drive, a circuit board populated with various electrical elements, and the like. The second enclosure 2 comprises a display panel 4. The first enclosure 1 and the second enclosure 2 are supported by hinge portions 3 to permit mutual opening and closing. The hinge portions 3 are equipped with a support shaft, not shown, which supports the first enclosure 1 and the second enclosure 2 in an openable manner.

A keyboard 5 and a pointing device 6 are located on the top surface 1*a* of the first enclosure 1. The keyboard 5 receives various character entry operations by the user. The pointing device 6 is a device receiving contact action by the user on its operative surface and allowing for operations whereby a cursor displayed on the display panel 4 is moved to the desired locations.

2. Configuration of the Keyboard 5

Figure 2:
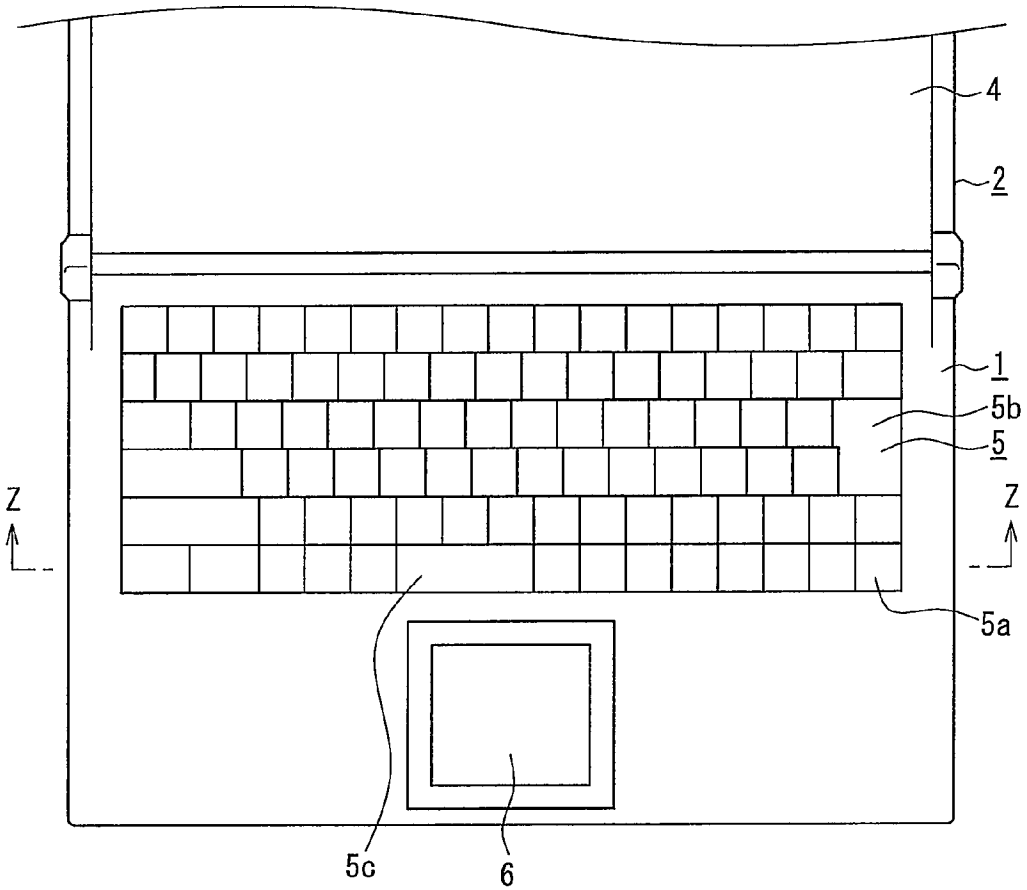
FIG. 2 is a plan view of a first enclosure.
Figure 3:
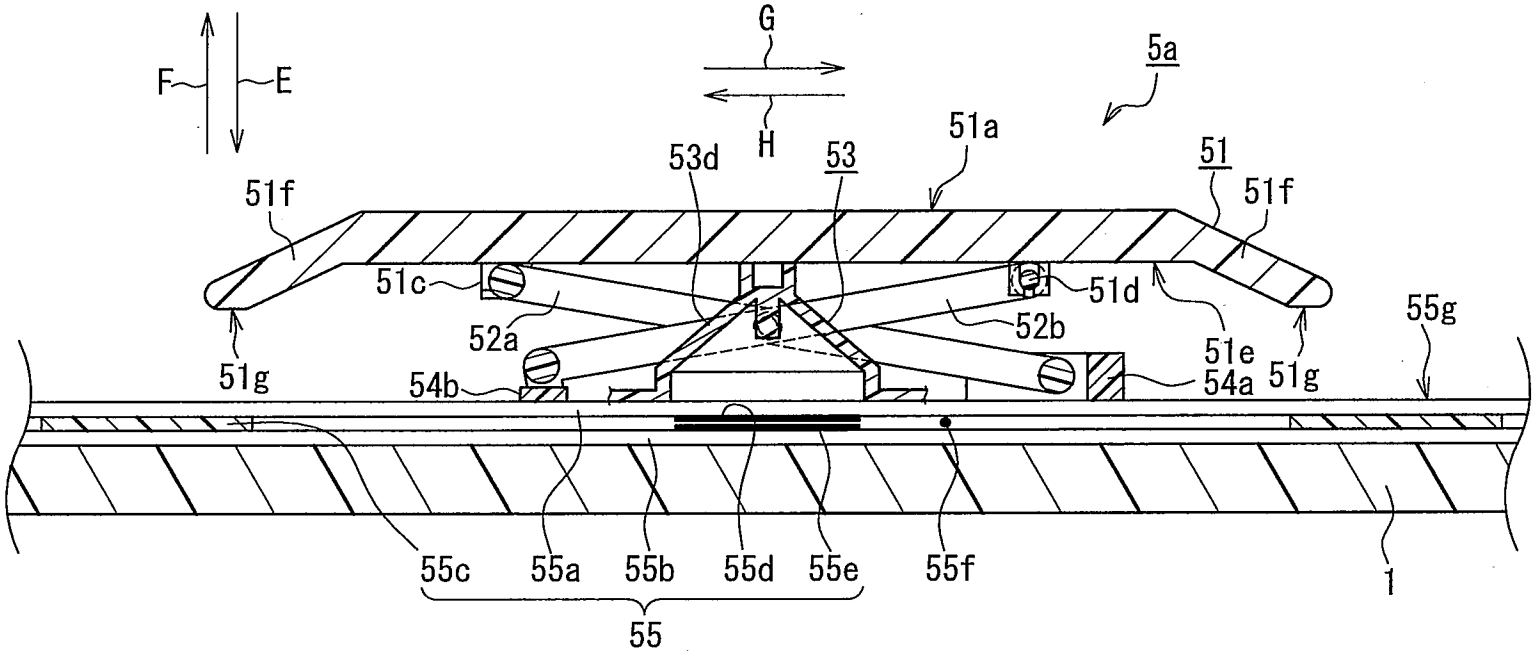
FIG. 3 is a cross-sectional view of portion Z-Z in FIG. 2 (when the key top is in the raised position).
Figure 4:
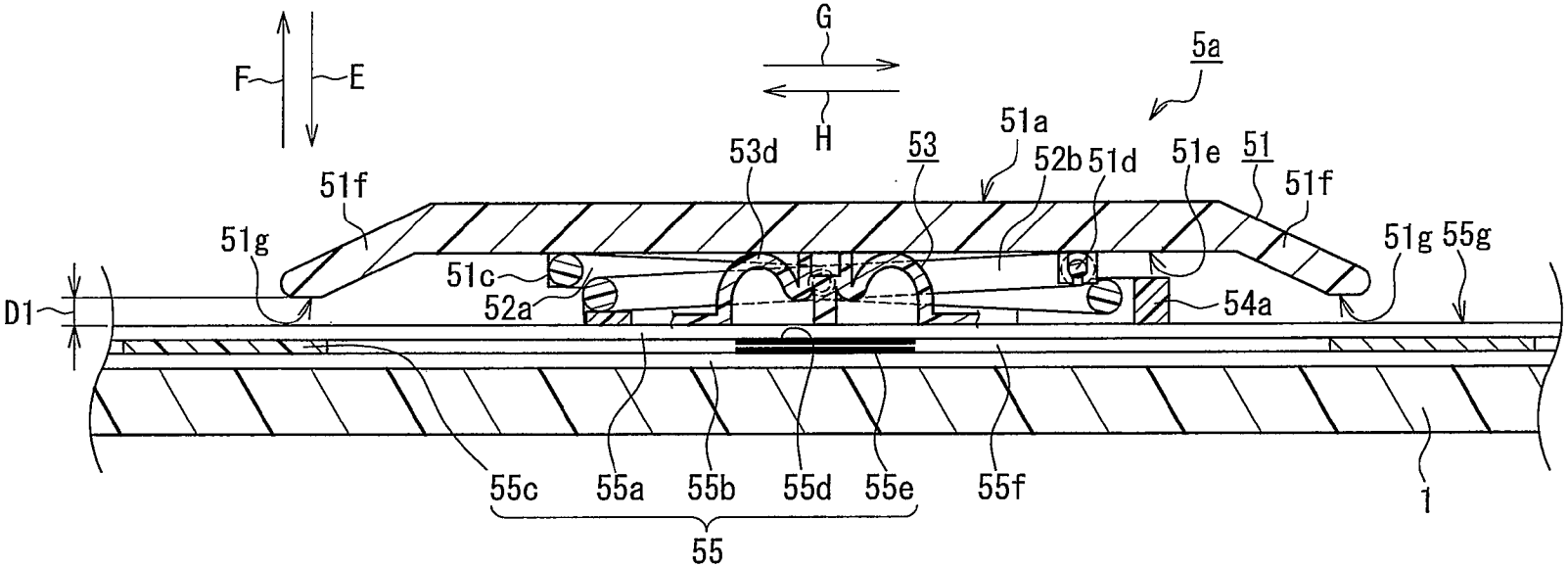
FIG. 4 is a cross-sectional view of portion Z-Z in FIG. 2 (when the key top is in the lowered position).
Figure 5:
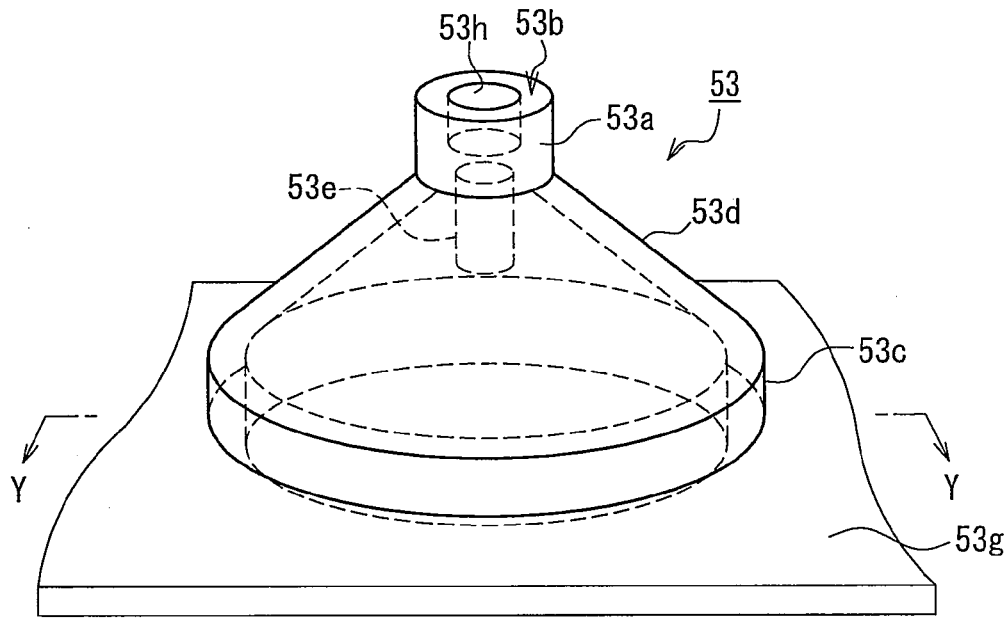
FIG. 5 is an oblique view of a resilient member.
Figure 6:
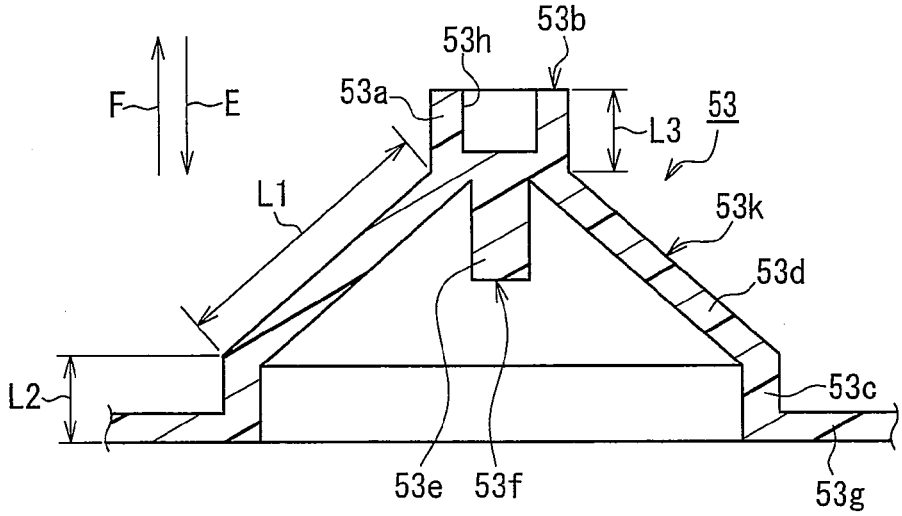
FIG. 6 is a cross-sectional view of portion Y-Y in FIG. 5.

FIG. 2 is a plan view of the first enclosure 1. FIG. 3 and FIG. 4 are enlarged partial cross-sectional views as seen in the Z-Z direction in FIG. 2. In FIG. 3, the key top is illustrated in the raised position. In FIG. 4, the key top is illustrated in the lowered position. FIG. 5 is an oblique view of the resilient member. FIG. 6 is a cross-sectional view of the resilient member (cross-sectional shape of portion YY in FIG. 5).

As shown in FIG. 2, the keyboard 5 is equipped with multiple keys. The keyboard 5 is, for example, an OADG (PC Open Architecture Developers'Group)-compliant keyboard (85 keys) used in notebook PCs and the like. The characters and functions that can be entered are assigned to the keys of the keyboard 5. While in this embodiment the key layout of the keyboard 5 is the QWERTY layout, it is not limited thereto and may be a different key layout, such as the AZERTY layout, the Dvorak layout, and the like.

While not shown in the drawing, the top surface of each key top (the surface the user pushes with a finger when entering characters and the like on the keyboard 5) of the keyboard 5 is often imprinted with an identification of the character or function, etc. that can be entered by pressing said key top. A specific configuration of the keyboard 5 is described below, with a single key, shown as key 5*a* in FIG. 2, used as an example.

As shown in FIG. 3, the key 5*a* has a key top 51, a first link member 52*a*, a second link member 52*b*, and a resilient member 53.

As shown in FIG. 2, the planar shape of the key top 51 is quadrangular and, as shown in FIG. 3, it is formed in the shape of a thin plate. On the top surface 51*a*, the key top 51 is often imprinted with characters, symbols, and the like representing the functions of the keys. A first link support portion 51*c* and a second link support portion 51*d* are formed on the bottom surface 51*e* (on the reverse side of the top surface 51*a*) of the key top 51. The first link support portion 51*c* has an opening, with one end of the first link member 52*a* movably supported in this opening. The second link support portion 51*d* has an opening, with one end of the second link member 52*b* mated with this opening in a loose fit. The key top 51 is provided with a slanted portion 51*f* on its outer periphery. The slanted portion 51*f* is formed to widen the gap available to the user's fingers between the key 5*a* and the adjacent keys provided on the operative surface (top surface 5*a*). Inclined towards the membrane sheet 55, the slanted portion 51*f* can also act to reduce the penetration of dirt and other foreign matter between the key top 51 and the membrane sheet 55.

As shown in FIG. 3, when viewed from the side, the first link member 52*a* and the second link member 52*b* are arranged in a mutually intersecting configuration. In the mutually intersecting portion, one of the link members among the first link member 52*a* and the second link member 52*b* is provided, for example, with a cylindrical protruding portion, while the other link member is provided with a hole formed in a circular shape and having an inside diameter slightly larger than the outside diameter of the protruding portion, with this protruding portion mated with the hole in a loose fit. The first link member 52*a* has one end thereof movably supported by the first link support portion 51*c* and has the other end thereof pivotably supported by a third link support portion 54*a* formed on the membrane sheet 55. The second link member 52*b* has one end thereof pivotably supported by the second link support portion 51*d* and has the other end thereof movably supported by a fourth link support portion 54*b* formed on the membrane sheet 55. The first link member 52*a* and the second link member 52*b* are members that guide the key top 51 in the direction of downward travel indicated by arrow E and in the direction of upward travel indicated by arrow F.

The resilient member 53 has an upper end portion 53*a*, an abutment surface 53*b*, a base 53*c*, a slanted portion 53*d*, a protruding portion 53*e*, an end face 53*f*, and a concave portion 53*h*. As shown in FIG. 5 and FIG. 6, the resilient member 53 is formed in a substantially conical shape with a hollow structure inside. It should be noted that the shape of the resilient member 53 is not limited to conical shapes and it may be of a different shape as long as the shape allows for the slanted portion 53*d* to be deformed into a convex shape upon application of pressure in the direction indicated by arrow E. The resilient member 53 is formed from a resilient material such as silicone rubber and the like. As shown in FIG. 3, when the key top 51 is not depressed, the resilient member 53 can support the key top 51 such that the key top 51 is not displaced by gravity in the direction indicated by arrow E.

When the key top 51 is depressed by the user from the non-depressed state in the direction indicated by arrow E, as shown in FIG. 3, the resilient member 53 is pushed and deformed by the key top 51 in the direction indicated by arrow E. In other words, the resilient member 53 undergoes deformation upon application of outside pressure (for example, pressure in the direction indicated by arrow E) and maintains the shape illustrated in FIG. 3, FIG. 5, and FIG. 6 when no pressure is applied.

The upper end portion 53*a*, which is provided at the upper end of the resilient member 53, is formed in a cylindrical shape. The concave portion 53*h* has a circular opening and can be mated with a protruding portion 51*b* (not shown) provided on the bottom surface 51*e* of the key top 51. It should be noted that the concave portion 53*h* can be eliminated if the upper end portion 53*a* can be joined to the key top 51 with the help of a different joining method. Formed in a cylindrical shape, the base 53*c* has an outside diameter larger than the outside diameter of the upper end portion 53*a*. The base 53*c* is secured to the top membrane sheet 55*a* of the membrane sheet 55. Provided between the upper end portion 53*a* and base 53*c*, the slanted portion 53*d* is formed in a generally conical shape. The slanted portion 53*d*, which is formed in a plate-like shape, has low rigidity and, as a result, undergoes resilient deformation more readily in comparison with the upper end portion 53*a* and base 53*c*. The protruding portion 53*e* is formed on the bottom surface (the surface on the reverse side of the abutment surface 53*b*) of the upper end portion 53*a*. When the key top 51 is in the lowered position as shown in FIG. 4, the end face 53*f* of the protruding portion 53*e* can abut the top membrane sheet 55*a*.

The third link support portion 54*a* supports the other end of the first link member 52*a*. The fourth link support portion 54*b* supports the other end of the second link member 52*b*. Upon displacement of the key top 51 from the position illustrated in FIG. 3 in the direction indicated by arrow E, the other end of the first link member 52*a* pivots about the third link support portion 54*a* and the other end of the second link member 52*b* moves in the direction indicated by arrow H. In addition, when the key top 51 is in the position illustrated in FIG. 3, one end of the first link member 52*a* abuts an inner wall (not shown) of the first link support portion 51*c* in the direction indicated by arrow G and the other end of the second link member 52*b* abuts an inner wall (not shown) of the fourth link support portion 54*b* in the direction indicated by arrow G. As a result, one end of the first link member 52*a* and the other end of the second link member 52*b* are restricted in their movement in the direction indicated by arrow G, thereby making it possible to restrict the displacement of the key top 51 from the position illustrated in FIG. 3 in the direction indicated by arrow F.

The membrane sheet 55 is provided with a top membrane sheet 55*a*, a bottom membrane sheet 55*b*, spacers 55*c*, a top contact 55*d*, and a bottom contact 55*e*. The top membrane sheet 55*a* and bottom membrane sheet 55*b* are arranged substantially parallel with respect to each other. The top membrane sheet 55*a* and bottom membrane sheet 55*b* are obtained by forming wiring patterns (not shown) of silver (Ag) ink etc., along with the top contact 55*d* and the bottom contact 55*e*, on a substrate formed from silicone rubber and the like.

The top contact 55*d* is formed on the surface of the top membrane sheet 55*a* in a face-to-face relationship with the bottom membrane sheet 55*b*. The bottom contact 55*e* is formed on the surface of the bottom membrane sheet 55*b* in a face-to-face relationship with the top membrane sheet 55*a*. The top contact 55*d* and bottom contact 55*e* are connected to wiring patterns (not shown) that are electrically connected to an electrical circuit board (not shown) inside the first enclosure 1.

The top membrane sheet 55*a* and bottom membrane sheet 55*b* are joined together, sandwiching the spacers 55*c* and a gap 55*f* therebetween. The predetermined gap 55*f* is formed between the top membrane sheet 55*a* and bottom membrane sheet 55*b* and, in particular, between the top contact 55*d* and bottom contact 55*e*, and the spacers 55*c* prevent the top contact 55*d* and bottom contact 55*e* from coming into contact with each other when the key top 51 is not depressed. The spacers 55*c* are arranged around each key provided in the keyboard 5, thereby preventing the top contact 55*d* and bottom contact 55*e* of keys adjacent to any depressed key from coming into contact with each other. It should be noted that the two contacts are spaced apart despite the fact that they are illustrated as being in contact in FIG. 3 because of the extremely small gap between the top contact 55*d* and bottom contact 55*e*. In addition, the top contact 55*d* and bottom contact 55*e* are in mutual contact when the key top 5*a* is in the lowered position as shown in FIG. 4.

The operation of the keyboard 5 will be described below.

In FIG. 3, the key top 51 is in a non-depressed state. In the state shown in FIG. 3, the key top 51 is arranged in the raised position by the resilient member 53 and its displacement by gravity in the direction indicated by arrow E is restricted. In addition, at such time, the top contact 55*d* and bottom contact 55*e* are spaced apart, sandwiching the gap 55*f*.

When the user depresses the key top 51 with a finger, etc. in the direction indicated by arrow E in the state shown in FIG. 3, the key top 51, guided by the first link member 52*a* and the second link member 52*b*, is displaced in the direction indicated by arrow E. At such time, the key top 51 is displaced in the direction indicated by arrow E while keeping the operative surface 51*a* parallel to the top surface 55*g* of the membrane sheet 55. When the key top 51 is displaced in the direction indicated by arrow E, the upper end portion 53*a* of the resilient member 53 is pushed by the key top 51 in the direction indicated by arrow E and the slanted portion 53*d* undergoes buckling deformation. When the key top 51 is displaced in the direction indicated by arrow E, the first link member 52*a* moves in the direction indicated by arrow H while one end thereof is supported by the first link support portion 51*c* and the other end thereof pivots about the third link support portion 54*a*. The second link member 52*b* has one end thereof pivoting about the second link support portion 51*d* and the other end thereof moving in the direction indicated by arrow H while being supported by the fourth link support portion 54*b*.

As shown in FIG. 4, when the key top 51 is displaced to the lowered position, the protruding portion 53*e* (see FIG. 5 and FIG. 6) formed on the resilient member 53 abuts the top membrane sheet 55*a*. When the key top 51 is displaced farther from this state in the direction indicated by arrow E, the protruding portion 53*e* applies pressure to the top membrane sheet 55*a* and the top membrane sheet 55*a* undergoes buckling deformation in the direction indicated by arrow E.

When the top membrane sheet 55*a* is deformed up to a predetermined position, the top contact 55*d* and bottom contact 55*e* come into contact with each other. The contact between the top contact 55*d* and bottom contact 55*e* results in a state where the wiring pattern formed on the top membrane sheet 55*a* and the wiring pattern formed on the bottom membrane sheet 55*b* are in electrical communication. Since the wiring patterns are electrically connected to the signal processing circuitry located in the first enclosure 1 (since the connected state is well-known, it is not illustrated), signal processing that corresponds to the depressed key is carried out in the signal processing circuitry. For example, if a predetermined character entry function has been assigned to the depressed key, control is exercised to display the assigned character on the display panel 4 located in the second enclosure 2.

When the user removes his or her finger from the key top 51 in the state shown in FIG. 4, the key top 51 rises in the direction indicated by arrow F under the action of the resilient restoring force of the resilient member 53. Namely, the resilient member 53 possesses a resilient restoring force sufficient to raise the key top 51 by pushing it upwardly in the direction indicated by arrow F. At such time, the key top 51 rises in the direction indicated by arrow F while keeping its orientation parallel to the top surface 55*g* of the membrane sheet 55 as a result of being guided in the up-and-down direction by the first link member 52*a* and the second link member 52*b*.

As the resilient member 53 returns from the deformed state to its original shape, the protruding portion 53*e* that has been applying pressure to the top membrane sheet 55*a* moves away from the top membrane sheet 55*a*. As the protruding portion 53*e* moves away, the top membrane sheet 55*a* returns from the buckled deformed state to its original shape (as shown in FIG. 3, the shape in which it is in a parallel facing relationship with the bottom membrane sheet 55*b*), and the top contact 55*d* moves away from the bottom contact 55*e*. The contact between the top contact 55*d* and bottom contact 55*e* produces a state, where the wiring pattern (not shown) of the top membrane sheet 55*a* and the wiring pattern (not shown) of the bottom membrane sheet 55*b* are electrically disconnected.

As shown in FIG. 3, when the key top 51 is displaced to the raised position, one end of the first link member 52*a* abuts an inner wall (not shown) of the first link support portion 51*c* in the direction indicated by arrow G and the other end of the second link member 52*b* abuts an inner wall (not shown) of the fourth link support portion 54*b* in the direction indicated by arrow G. As a result, one end of the first link member 52*a* can be restricted in its movement in the direction indicated by arrow G and the other end of the second link member 52*b* can be restricted in its movement in the direction indicated by arrow G, which makes it possible to restrict the displacement of the key top 51 from the raised position illustrated in FIG. 3 in the direction indicated by arrow F. As a result of the above operation, the key top 51 returns to the raised position illustrated in FIG. 3.

3. Operation of the Resilient Member 53

The operation of the resilient member 53 during the up-and-down action of the key top 51 will now be described.

As shown in FIG. 3, when the key top 51 is in the raised position, the resilient member 53 remains practically free of deformation and maintains a neutral state even though the weight of the key top 51 is applied thereto. When the key top 51 is displaced from the state shown in FIG. 3 in the direction indicated by arrow E, the upper end portion 53*a* is pushed and displaced by the key top 51 in the direction indicated by arrow E.

As the upper end portion 53*a* is displaced in the direction indicated by arrow E, the slanted portion 53*d* undergoes buckling deformation. Namely, as shown in FIG. 6, since the length L1 of the slanted portion 53*d* is greater than the length L2 of the base 53*c* and length L3 of the upper end portion 53*a*, its rigidity is lower and it is more readily deformable. Therefore, as the upper end portion 53*a* is displaced in the direction indicated by arrow E, the area in the vicinity of the boundary between the slanted portion 53*d* and the upper end portion 53*a* undergoes bending deformation as shown in FIG. 4 while the central area between the upper end portion 53*a* and base 53*c* undergoes buckling deformation. It should be noted that the area around the center of the slanted portion 53*d* undergoes buckling deformation such that the surface 53*k* assumes a convex shape. In addition, due to its higher rigidity in comparison with the slanted portion 53*d*, the base 53*c* remains practically free of deformation when the slanted portion 53*d* is deformed.

As shown in FIG. 4, when the key top 51 is in the lowered position, the surface 53*k* of the slanted portion 53*d* of the resilient member 53 abuts the bottom surface 51*e* of the key top 51. Specifically, the portion of the surface 53*k* of the slanted portion 53*d* that undergoes buckling deformation abuts the bottom surface 51*e* of the key top 51. When the surface 53*k* of the slanted portion 53*d* is in a state of abutment against the bottom surface 51*e* of the key top 51, a gap D1 is formed between the edge 51*g* of the key top 51 and the surface 55*g* of the membrane sheet 55. In other words, the slanted portion 53*d* of the resilient member 53 has a length L1 such that it allows for a gap D1 to be formed between the key top 51 and membrane sheet 55 when it undergoes buckling deformation and abuts the bottom surface 51*e* of the key top 51.

4. Effects of the Embodiment, etc.

In accordance with this embodiment, a configuration is used, in which the slanted portion 53*d* of the resilient member 53 can abut the bottom surface 51*e* of the key top 51 and a gap D1 shown in FIG. 4 is formed between the key top 51 and the membrane sheet 55 when the key top 51 is displaced to the lowered position, as a result of which the key top 51 can be prevented from abutting the membrane sheet 55 when the key top 51 is displaced by the user from the raised position (see FIG. 3) to the lowered position (see FIG. 4). As a result, the noise of collision between the key top 51 and the membrane sheet 55 is no longer produced and the key impact noise of the keyboard 5 can be diminished. It should be noted that although the bottom surface 51*e* of the key top 51 and the slanted portion 53*d* deformed by buckling collide when the key top 51 is displaced to the lowered position, the noise of collision between the key top 51 and the slanted portion 53*d* is extremely quiet and there is no increase in the key impact noise of the keyboard 5 because the resilient member 53 is formed from a soft material such as rubber.

In addition, in accordance with this embodiment, a configuration, in which the key top 51 is caused to abut the resilient member 53 when the key top 51 is displaced to the lowered position, allows for the impacts transmitted to the key top 51 to be reduced because the resilient member 53 is formed from a soft material such as rubber. As a result, the impacts transmitted to the fingers of the user performing data entry operations on the keyboard 5 can be reduced and the discomfort felt by the user can be alleviated. The effects become particularly pronounced when entering keystrokes on the keyboard 5 for an extended period of time.

In addition, in accordance with this embodiment, the keyboard 5 can be imparted with a noise suppressing construction without adding special components to the membrane switch, for example, such as the dot spacers described in Patent Document 1. Therefore, it is possible to implement the keyboard 5 at low cost while making it thinner.

It should be noted that while the description of this embodiment referred to the key 5*a*, which has a relatively small operative surface area among the keys provided on the keyboard 5 illustrated in FIG. 2, the configuration of this embodiment can be used with keys having a larger operative surface, for example the ENTER key 5*b*, or the Space key 5*c*, etc. illustrated in FIG. 2. In such a case, the first link member 52*a* and the second link member 52*b* provided in the large-sized keys, for example, the ENTER key 5*b*, the Space key 5*c*, and the like, can be implemented by increasing their relative size in comparison with the first link member 52*a* and the second link member 52*b* provided in small-sized keys, e.g. the key 5*a*. It should be noted that while the large-sized keys of conventional keyboards are provided with a rod-shaped member arranged in the longitudinal direction of the key top and link members of the same size as the link members provided in the small-sized keys, providing enlarged link members matching the size of the large-sized key in this embodiment allows for the rod-shaped member to be eliminated.

In addition, while the resilient member 53 was formed from silicone rubber in this embodiment, it can be formed from other materials as long as the material undergoes resilient deformation upon application of pressure by the key top 51.

In addition, while a concave portion 53*h* was provided in the upper end portion 53*a* of the resilient member 53 in this embodiment, the concave portion 53*h* can be eliminated as long as the positional displacement between the resilient member 53 and key top 51 can be minimized, for example, by using a material of low slipperiness as the material of the resilient member 53.

In addition, although this embodiment used a configuration in which the rigidity of the slanted portion 53*d* was reduced in comparison with the rigidity of the upper end portion 53*a* and the base 53*c* by making the length L1 of the slanted portion 53*d* longer than the length L2 of the base 53*c* and the length L3 of the upper end portion 53*a*, as a configuration that made the slanted portion 53*d* readily deformable, other configurations may also be used.

Figure 7:
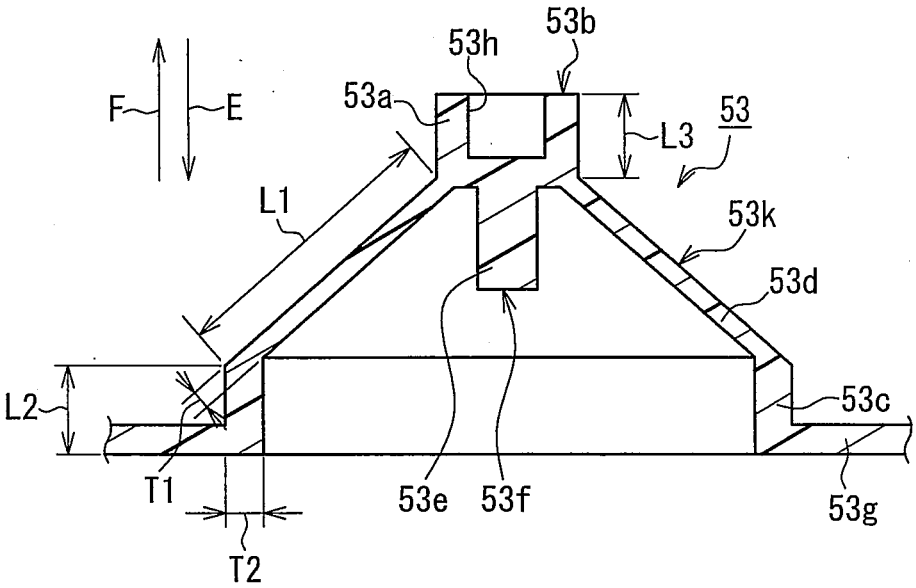
FIG. 7 is a cross-sectional view illustrating a variation of the resilient member.
Figure 8:
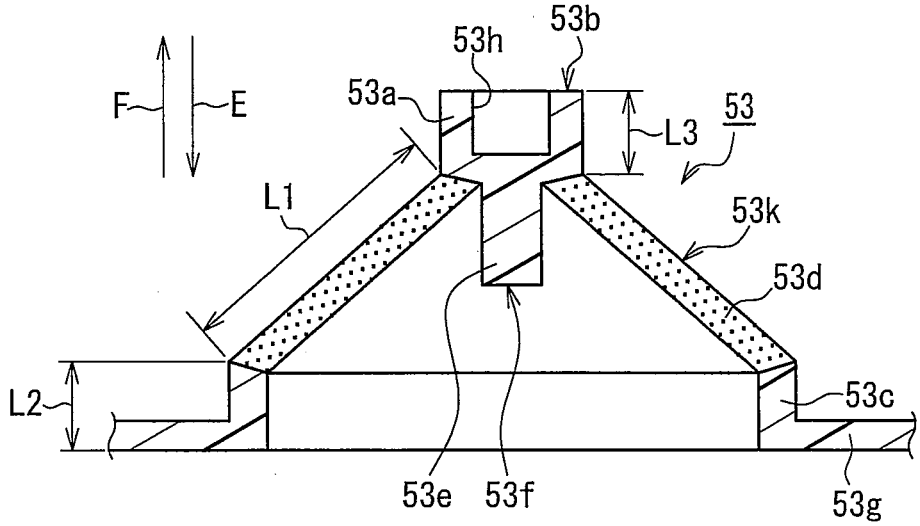
FIG. 8 is a cross-sectional view illustrating a variation of the resilient member.
Figure 9:
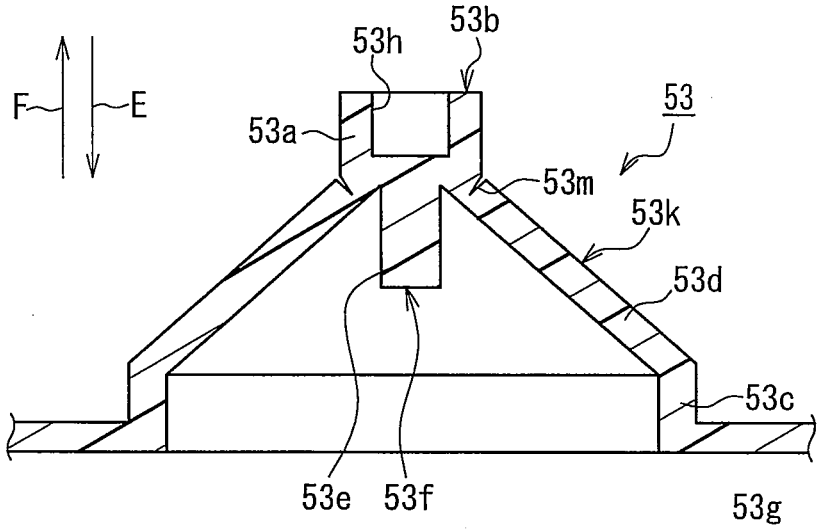
FIG. 9 is a cross-sectional view illustrating a variation of the resilient member.

FIG. 7-FIG. 9 are variations of the resilient member 53.

FIG. 7 is a cross-sectional view of the resilient member 53, in which the thickness T1 of the slanted portion 53*d* is reduced in comparison with the thickness T2 of the base 53*c*. Using the configuration illustrated in FIG. 7 allows for the rigidity of the slanted portion 53*d* to be reduced in comparison with the rigidity of the base 53*c*, thereby causing the slanted portion 53*d* to be deformed preferentially by buckling upon application of pressure to the resilient member 53 in the direction indicated by arrow E. It should be noted that the configuration of the resilient member 53 illustrated in FIG. 7 is identical to that of the resilient member 53 illustrated in FIG. 6 with the exception of the slanted portion 53*d*. In addition, while the thickness T1 of the slanted portion 53*d* illustrated in FIG. 7 is reduced throughout the entire slanted portion, similar effects can be obtained even in configurations in which the thickness is only partially reduced.

FIG. 8 is a cross-sectional view of the resilient member 53, in which the material of the slanted portion 53*d* is different from the material of the upper end portion 53*a* and base 53*c*. The material of the slanted portion 53*d* illustrated in FIG. 8 is a material whose stiffness is lower than that of the material of the upper end portion 53*a* and base 53*c*. Using the configuration illustrated in FIG. 8 allows for the rigidity of the slanted portion 53*d* to be reduced in comparison with the rigidity of the base 53*c*, thereby causing the slanted portion 53*d* to be preferentially deformed by buckling upon application of pressure to the resilient member 53 in the direction indicated by arrow E. It should be noted that the configuration of the resilient member 53 illustrated in FIG. 8 is identical to that of the resilient member 53 illustrated in FIG. 6 with the exception of the slanted portion 53*d*. In addition, while the slanted portion 53*d* illustrated in FIG. 8 is made entirely of a low-rigidity material, similar effects can be obtained even in configurations in which it is only partially formed from a low-rigidity material.

FIG. 9 is a cross-sectional view of the resilient member 53, in which a wedge-shaped groove portion 53*m* is provided in the vicinity of the boundary between the slanted portion 53*d* and the upper end portion 53*a*. The configuration of the resilient member 53 illustrated in FIG. 9 is identical to that of the resilient member 53 illustrated in FIG. 6 with the exception of the groove portion 53*m*. Using the configuration illustrated in FIG. 9 causes the portion in the vicinity of the groove portion 53*m* to be preferentially bent upon application of pressure to the resilient member 53 in the direction indicated by arrow E, thereby causing the slanted portion 53*d* to preferentially undergo buckling deformation. It should be noted that while in the configuration illustrated in FIG. 9 the groove portion 53*m* is formed on the surface 53*k* of the slanted portion 53*d*, it also may be formed on the surface of the reverse side of the surface 53*k*. In addition, the groove portion 53*m* may be formed on the slanted portion 53*d* without being limited to the vicinity of the boundary between the upper end portion 53*a* and the slanted portion 53*d*. In addition, the groove portion 53*m* is not limited to a single location and may be formed in multiple locations.

In addition, while the thickness of the slanted portion 53*d* of the resilient member 53 in this embodiment is uniform, it is preferable to render the thickness non-uniform such that the thickness of the slanted portion 53*d* in the central area between the upper end portion 53*a* and base 53*c* is reduced in comparison with the thickness on the side closer to the base 53*c*. Specifically, a configuration can be used in which the thickness is increased in a smooth manner starting from around the center of the slanted portion 53*d* towards the base 53*c* until it is connected to the base 53*c*. Using such a configuration allows for the portion in which the thickness in the slanted portion 53*d* is reduced to preferentially undergo buckling deformation upon application of pressure to the resilient member 53 and its deformation in the direction indicated by arrow E. In other words, it can be ensured that the side of the slanted portion 53*d* facing the upper end portion 53*a* undergoes buckling deformation. In addition, using such a configuration facilitates the manufacture of the resilient member 53, e.g. making it easier to remove from the mold, etc.

In addition, although a notebook computer was offered as an example of the electronic apparatus in this embodiment, the configuration of the present embodiment can be utilized in any apparatus other than a notebook computer as long as the apparatus is equipped with at least a keyboard. In addition, the electronic apparatus of this embodiment includes keyboard units that only comprise a keyboard and can be connected to a PC, etc.

The key top 51 used in this embodiment is an example of a key top. The first link member 52*a* and the second link member 52*b* used in this embodiment are an example of the lifting/lowering mechanism. The membrane sheet 55 used in this embodiment is an example of a substrate. The resilient member 53 used in this embodiment is an example of a resilient member. The top contact 55*d* and bottom contact 55*e* used in this embodiment are an example of the contact portion. The upper end portion 53*a* used in this embodiment is an example of an abutting portion. The base 53*c* used in this embodiment is an example of an affixed portion. The slanted portion 53*d* used in this embodiment is an example of a deformable portion.

Furthermore, this application discloses the following variations. It should be noted that the effects obtained in this embodiment further can be enhanced by combining, as appropriate, the configuration of the resilient member 53 disclosed in Embodiment 1 with the configuration of the resilient member 56 disclosed in Variation 1, the configuration of the resilient member 58 disclosed in Variation 2, and/or the configuration of the resilient member 57 disclosed in the Variation 3.

Variation 1

Figure 10:
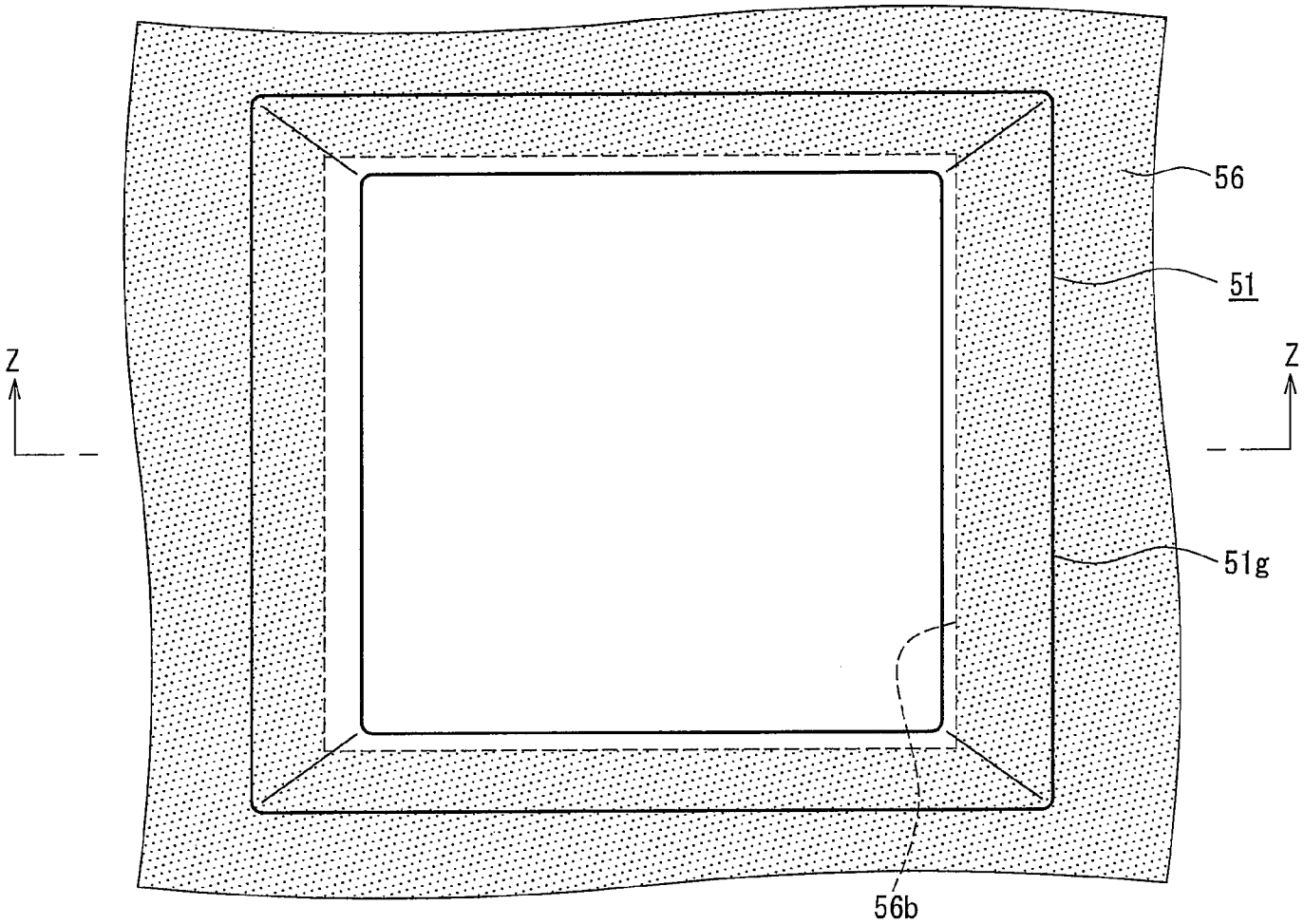
FIG. 10 is an enlarged plan view illustrating the configuration of Variation 1 of the key.
Figure 11:
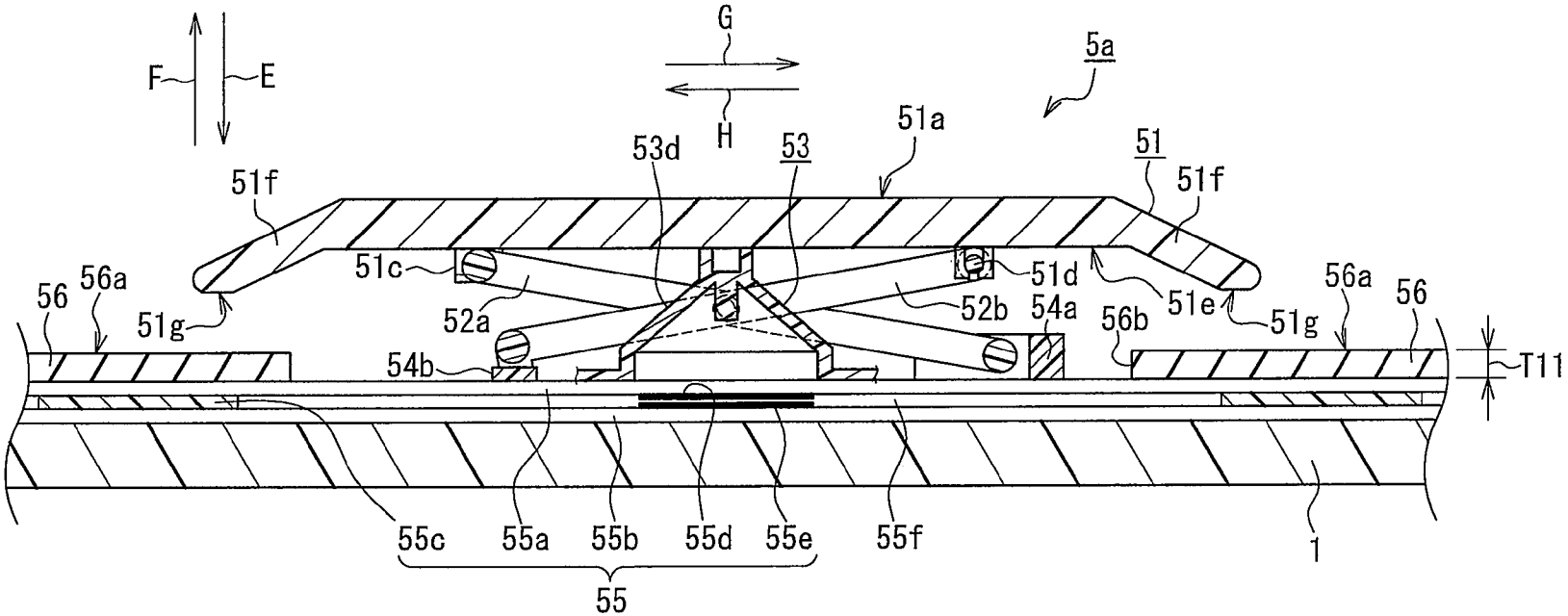
FIG. 11 is a cross-sectional view of portion Z-Z in FIG. 10 (when the key top is in the raised position).
Figure 12:
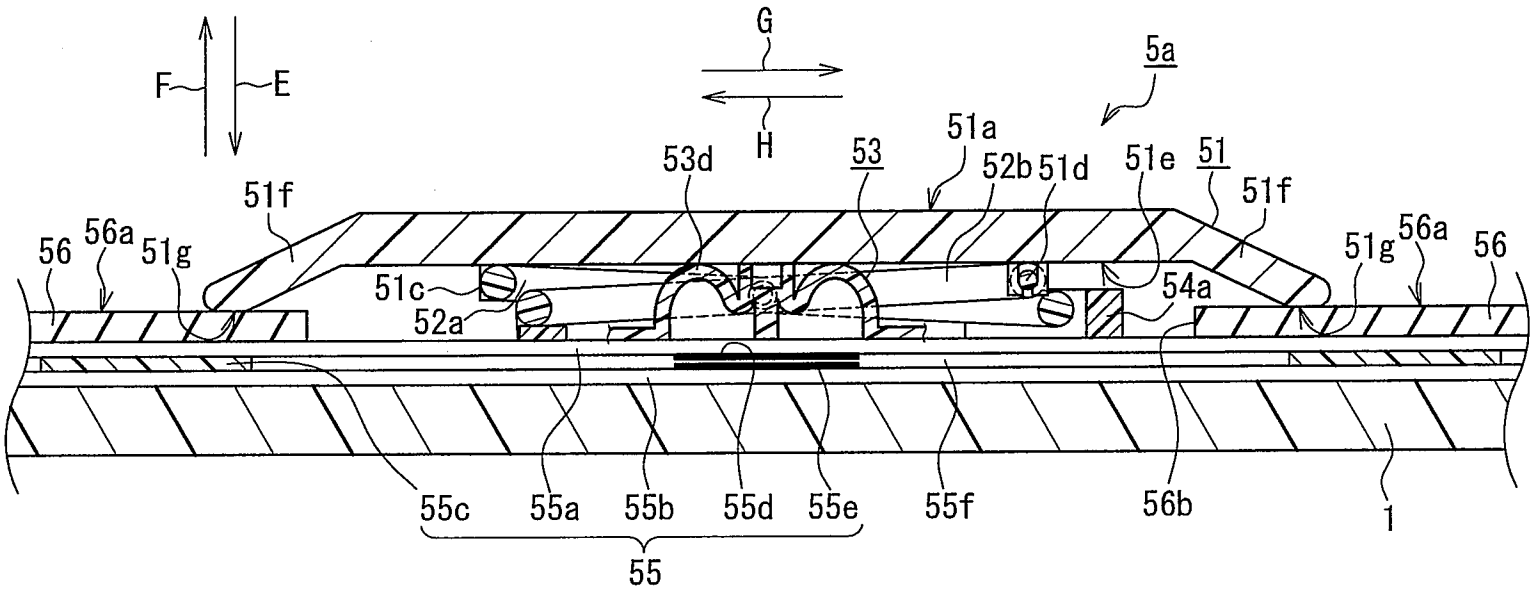
FIG. 12 is a cross-sectional view of portion Z-Z in FIG. 10 (when the key top is in the lowered position).

FIG. 10 is an enlarged plan view illustrating a configuration obtained by additionally providing a resilient sheet 56 in the key 5*a* illustrated in FIG. 3. FIG. 11 and FIG. 12 are cross-sectional views of portion Z-Z in FIG. 10. In FIG. 11 illustrates the key top 51 in the raised position. In FIG. 12 illustrates the key top 51 in the lowered position.

The resilient sheet 56 is located on the top surface 55*g* of the top membrane sheet 55*a*. The resilient sheet 56 is formed from a sheet of resilient material. The resilient sheet 56 is formed from a material that is capable of absorbing impacts produced when the key top 51 collides therewith and thus abates the collision noise. For example, it can be formed from silicone rubber. The resilient sheet 56 is bonded to the top surface 55*g* of the top membrane sheet 55*a* using, for example, an adhesive agent.

The resilient sheet 56 may be provided independently for each individual key of the keyboard 5. Alternatively, a single resilient sheet 56 may be provided for all the keys of the keyboard 5. Using a configuration that provides a single resilient sheet 56 for the all the keys of the keyboard 5 allows for the assembly of the keyboard 5 to be improved. The resilient sheet 56 of this embodiment is provided such that all of the keys of the keyboard 5 are taken care of by a single resilient sheet, with openings 56*b* provided in locations corresponding to each key. The first link member 52*a*, second link member 52*b*, and resilient member 53 are arranged in positions permitting passage through the openings 56*b* in the resilient sheet 56.

It is sufficient for the resilient sheet 56 to be of a thickness T11 which, in this embodiment, permits abutment by the edge 51*g* in at least a portion of the key top 51, namely, the portion closest to the membrane sheet 55, and does not impede contact between the top electrode 55*d* and bottom electrode 55*e* when the key top 51 is in the lowered position.

As shown in FIG. 10, the resilient sheet 56 is arranged in a position overlapping with the edge 51*g* in this embodiment, i.e. at least the portion of the key top 51 that is closest to the membrane sheet 55.

In the above-described configuration, when the key top 51 is depressed from the raised position illustrated in FIG. 11 in the direction indicated by arrow E, the edge 51*g* of the key top 51, as shown in FIG. 12, abuts the top surface 56*a* of the resilient sheet 56. Since the resilient sheet 56 is formed from a material of low hardness, such as silicone rubber and the like, the collision noise produced upon abutment of the edge 51*g* of the key top 51 is quiet. Specifically, since the resilient sheet 56 is formed from a material whose hardness is at least lower than the material of the membrane sheet 55, the collision noise produced upon abutment of the edge 51*g* of the key top 51 is quieter than the collision noise produced when the edge 51*g* of the key top 51 abuts the membrane sheet 55.

Accordingly, the key impact noise produced by entering keystrokes on the keyboard 5 can be abated.

In addition, in accordance with the present variation, the impacts transmitted to the fingers of the user performing data entry operations on the keyboard 5 can be reduced and the discomfort felt by the user can be alleviated. The effects become particularly pronounced when entering keystrokes on the keyboard 5 for an extended period of time.

In addition, in accordance with this variation, providing the resilient sheet 56 makes it possible to prevent collision between the resilient sheet 56 and the membrane sheet 55 and abate collision noise even if the key top 51 is depressed in a tilted orientation.

It should be noted that while in this variation, as shown in FIG. 10, the resilient sheet 56 was provided in a location in which it could abut the entire periphery of the edge 51*g* of the key top 51, it is sufficient to provide the resilient sheet 56 in a location, in which it can abut at least a portion of the edge 51*g*. An example of such a configuration will be described below as Variation 2.

In addition, while in this variation the resilient sheet 56 was provided on the top surface 55*g* of the membrane sheet 55, a resilient member formed from the same material as the resilient sheet 56 may be provided on the edge 51*g* of the key top 51. The resilient member provided on the edge 51*g* of the key top 51 is preferably bonded to the edge 51*g* with an adhesive agent. Using such a configuration makes it possible to obtain effects similar to Variation 1 described above.

The resilient sheet 56 is an example of a first sound dampening member. It should be noted that the term "sound dampening member" is not limited to members capable of completely canceling the collision noise produced upon abutment of the key top 51 and includes members capable of abating the collision noise. In other words, while it is desirable to completely cancel the collision noise produced upon abutment of the key top 51, low level collision noise is still produced in many cases. Since it is an object of the present embodiment to abate this type of collision noise in comparison with the prior-art configurations, in this specification, the meaning of the word "dampening" can be interpreted in a broad sense to include not only complete cancellation of the collision noise but also a reduction in the collision noise.

Variation 2

Figure 13:
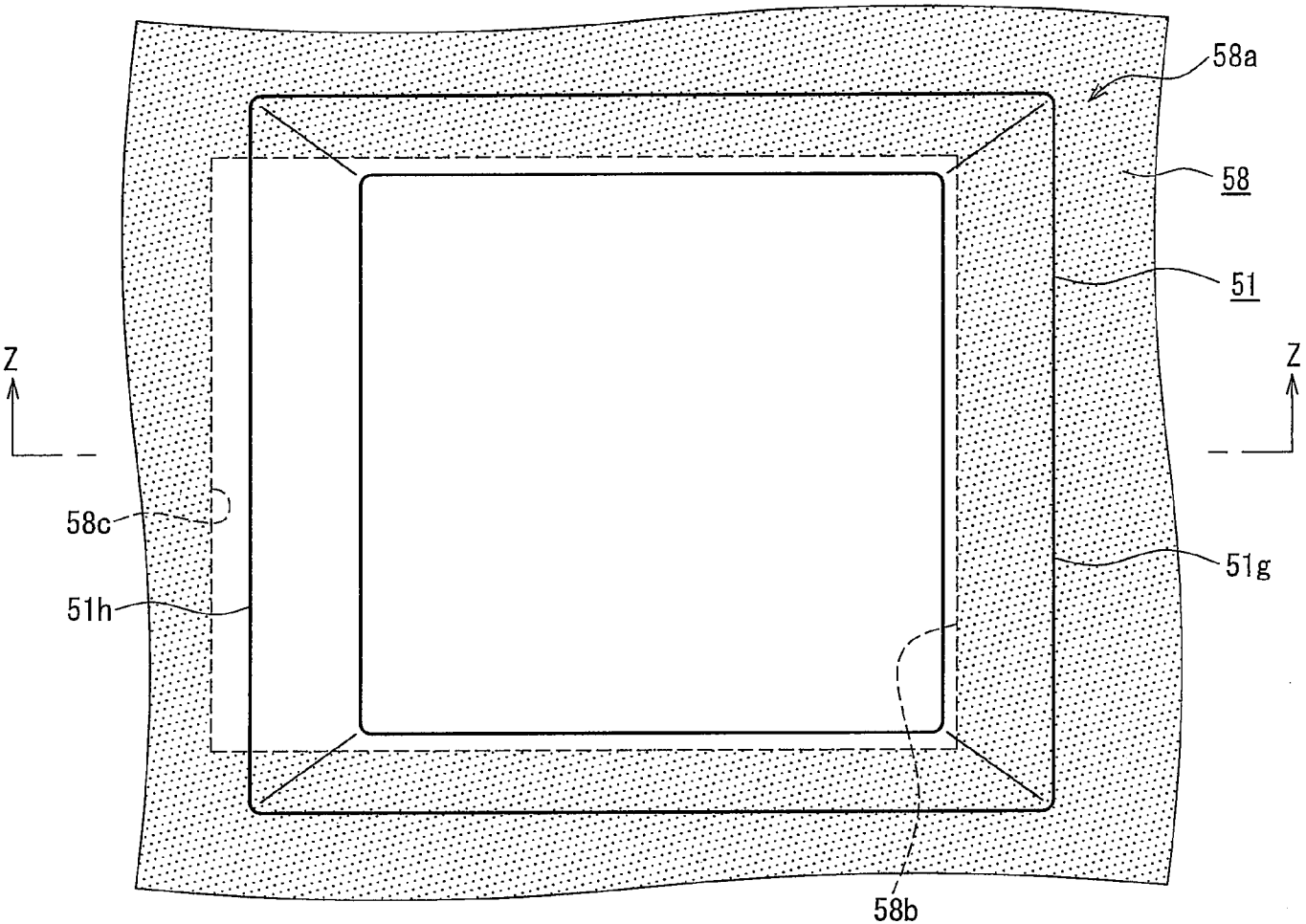
FIG. 13 is an enlarged plan view illustrating the configuration of Variation 2 of the key.
Figure 14:
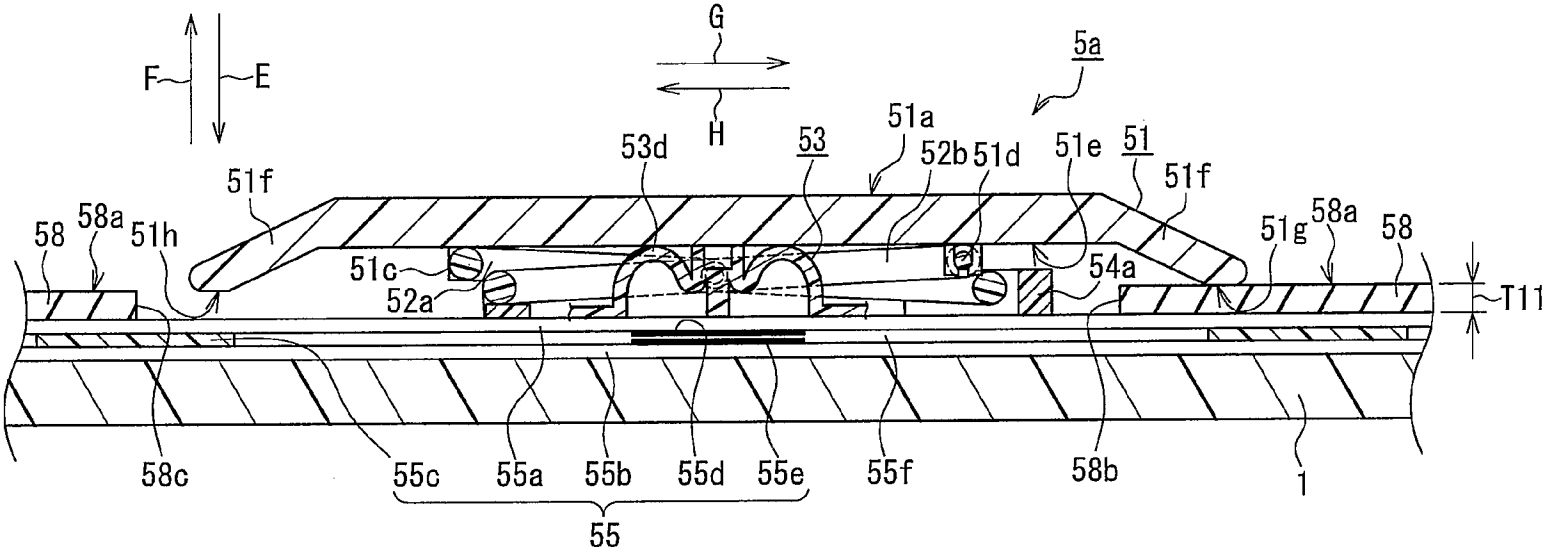
FIG. 14 is a cross-sectional view of portion Z-Z in FIG. 13.

FIG. 13 is an enlarged plan view illustrating a configuration obtained by additionally providing a resilient sheet 58 in the key 5*a* illustrated in FIG. 3. FIG. 14 is a cross-sectional view of portion Z-Z in FIG. 13. In FIG. 14 illustrates the key top 51 in the lowered position.

The resilient sheet 58 is arranged on the top surface 55*g* of the top membrane sheet 55*a*. The resilient sheet 58 is formed from a sheet of resilient material. The resilient sheet 58 is formed from a material that is capable of absorbing the impacts produced when the key top 51 collides therewith and thus abates the collision noise. For example, it can be formed from silicone rubber. The resilient sheet 58 is bonded to the top surface 55*g* of the top membrane sheet 55*a* using, for example, an adhesive agent.

The resilient sheet 58 may be provided independently for each individual key of the keyboard 5. Alternatively, a single resilient sheet 58 may be provided for all the keys of the keyboard 5. A configuration that provides a single resilient sheet 58 for the all the keys of the keyboard 5 makes it possible to improve the assembly of the keyboard 5. The resilient sheet 58 is provided such that all of the keys of the keyboard 5 are taken care of by a single resilient sheet, with openings 58*b* provided in locations corresponding to each key. The first link member 52*a*, second link member 52*b*, and resilient member 53 are arranged in positions permitting passage through the openings 58*b* in the resilient sheet 58.

It is sufficient for the resilient sheet 58 to be of a thickness T11 (see FIG. 14) which, in this embodiment, permits abutment by the edge 51*g* in at least a portion of the key top 51, namely, the portion closest to the membrane sheet 55, and does not impede contact between the top electrode 55*d* and bottom electrode 55*e* when the key top 51 is in the lowered position.

As shown in FIG. 13, the resilient sheet 58 is arranged in a position overlapping with the edge 51*g* in this embodiment, i.e. at least the portion of the key top 51 that is closest to the membrane sheet 55.

In the resilient sheet 58, the edge 58*c* of the opening 58*b* is arranged in a position that does not overlap with the key top 51. Namely, the opening 58*b* has continuous space extending from the lower portion of the key top 51 to a position that does not overlap with the key top 51. The side of the opening 58*b* where the edge 58*c* is located is in communication with the external space. As shown in FIG. 14, when the key top 51 is displaced to the lowered position in this type of configuration, most of the edge 51*g* of the key top 51 abuts the top surface 58*a* of the resilient sheet 58, but a portion 51*h* of the edge 51*g* does not abut the resilient sheet 58 and is arranged in a face-to-face relationship with the membrane sheet 55 across a gap. At such time, the opening 58*b* is spatially connected to the exterior through the gap between the membrane sheet 55 and the portion 51*h* of the edge 51*g* of the key top 51.

In the above-described configuration, when the key top 51 is caused to travel downwardly from the raised position, the edge 51*g* of the key top 51 abuts the top surface 58*a* of the resilient sheet 58 as shown in FIG. 14. Since the resilient sheet 58 is formed from a material of low hardness, such as silicone rubber and the like, the collision noise produced upon abutment of the edge 51*g* of the key top 51 is quiet. Specifically, since the resilient sheet 58 is formed from a material whose hardness is at least lower than the material of the membrane sheet 55, the collision noise produced upon abutment of the edge 51*g* of the key top 51 is quieter than the collision noise produced when the edge 51*g* of the key top 51 abuts the membrane sheet 55. Accordingly, the key impact noise produced by entering keystrokes on the keyboard 5 can be abated.

In addition, in accordance with the present variation, as a result of providing the resilient sheet 58, the impacts produced by the collision between the key top 51 and the resilient sheet 58 can be reduced, thereby permitting a reduction in the transmission of the impacts to the fingers of the user performing data entry operations on the keyboard 5 and allowing for the discomfort felt by the user to be alleviated. The effects become particularly pronounced when entering keystrokes on the keyboard 5 for an extended period of time.

In addition, in accordance with this variation, providing the resilient sheet 58 makes it possible to prevent collision between the resilient sheet 58 and the membrane sheet 55 and abate the collision noise even if the key top 51 is depressed in a tilted orientation.

In addition, in accordance with this variation, as a result of forming the side of the opening 58*b* in the resilient sheet 58 where the edge 58*c* is located such that it is in communication with external space beyond the edge 51*h* of the key top 51, the edges 51*g* and 51*h* etc and the opening 58*b* are not in a hermetically sealed condition and the air pressure inside the opening 58*b* does not decrease even though the opening 58*b* is blocked by the key top 51 when the key top 51 is displaced to the lowered position as shown in FIG. 14. Therefore, when the user displaces his or her finger away from the key top 51 in a state, in which the key top 51 is in the lowered position illustrated in FIG. 14, the key top 51 is quickly and reliably displaced to the raised position (for example, see FIG. 11). This can improve the operability of the keyboard 5.

For example, if the opening 58*b* is hermetically sealed and the air pressure inside the opening 58*b* is decreased upon displacement of the key top 51 to the lowered position, the key top 51 is brought into a state in which it remains stuck to the resilient sheet 58. Therefore, even if the user takes his or her finger away from the key top 51, the key top 51 may either rise immediately, or may remain in the lowered position. In this variation, as a result of preventing the opening 58*b* from becoming hermetically sealed, the air pressure inside the opening 58*b* equalizes with atmospheric pressure and the rising action of the key top 51 is not hindered.

It should be noted that while in this variation the resilient sheet 58 was provided on the top surface 55*g* of the membrane sheet 55, a resilient member formed from the same material as the resilient sheet 58 may be provided on the edge 51*g* of the key top 51. The resilient member provided on the edge 51*g* of the key top 51 is preferably bonded to the edge 51*g* with an adhesive agent. Using such a configuration makes it possible to obtain effects similar to Variation 1 described above.

In addition, while the portion of the opening 58*b* that was in communication with the external space was provided only in one location, it may be provided in multiple locations if at least the key top 51 can be caused to abut the resilient sheet 58 in a reliable and stable manner. In addition, while a resilient sheet 58 permitting communication with external space between the key top 51 and resilient sheet 58 was described using a configuration similar in length to the edge 51*h* of the key top 51, even if the part placed in communication with the external space is just a portion of the edge 51*h*, the part can be used as long as it is linked to the external space. Furthermore, it is possible to use a configuration, in which the resilient sheet 58 is provided, for instance, on the slanted portion 51*f* of the key top 51.

The resilient sheet 58 is an example of a first sound dampening member.

Variation 3

The keyboard 5 according to Variation 3 has a configuration, in which a resilient sheet 57 is additionally provided in the key 5*a*.

Figure 15:
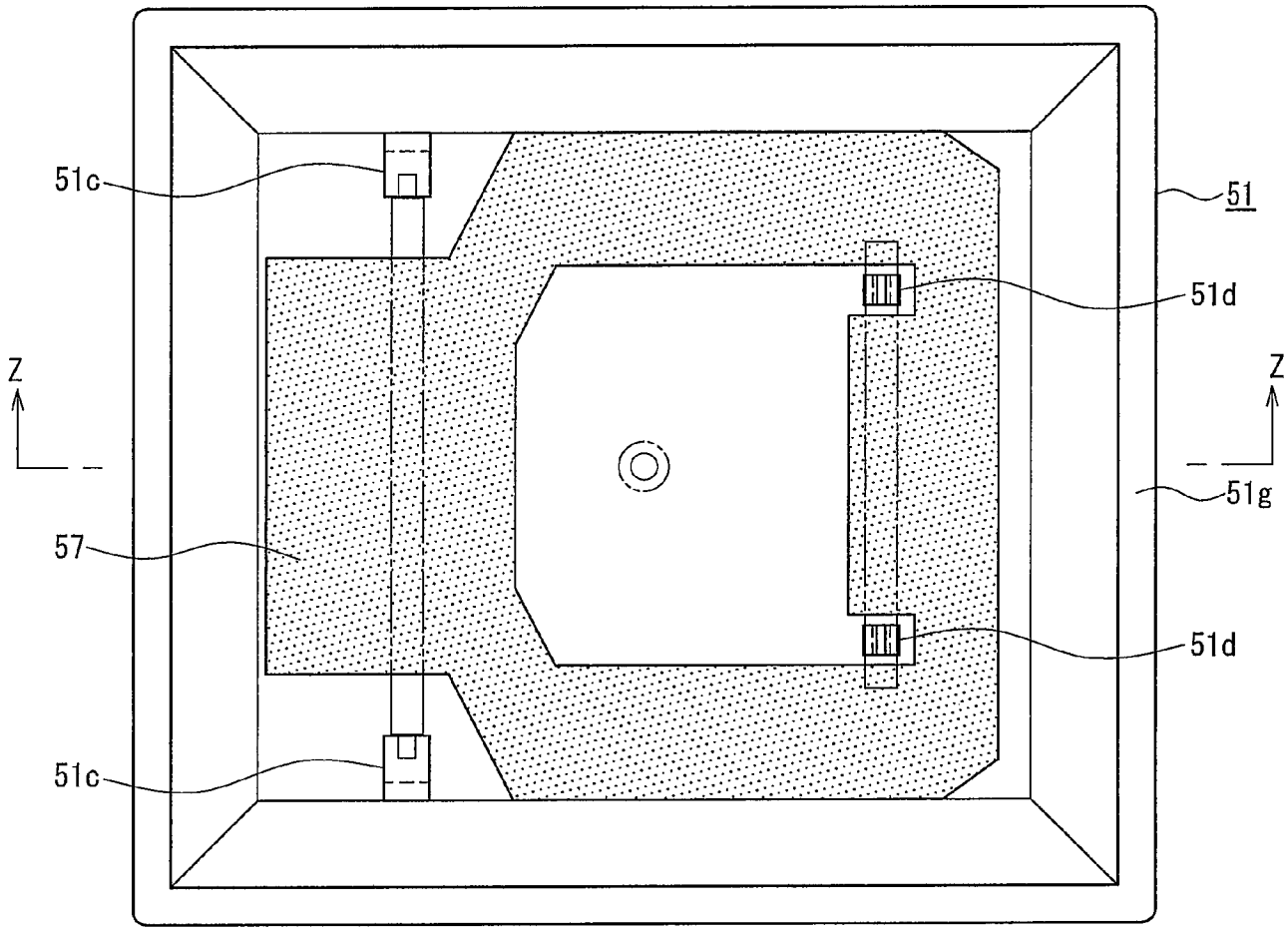
FIG. 15 is a plan view of the underside of the key top in Variation 3 of the key.
Figure 16:
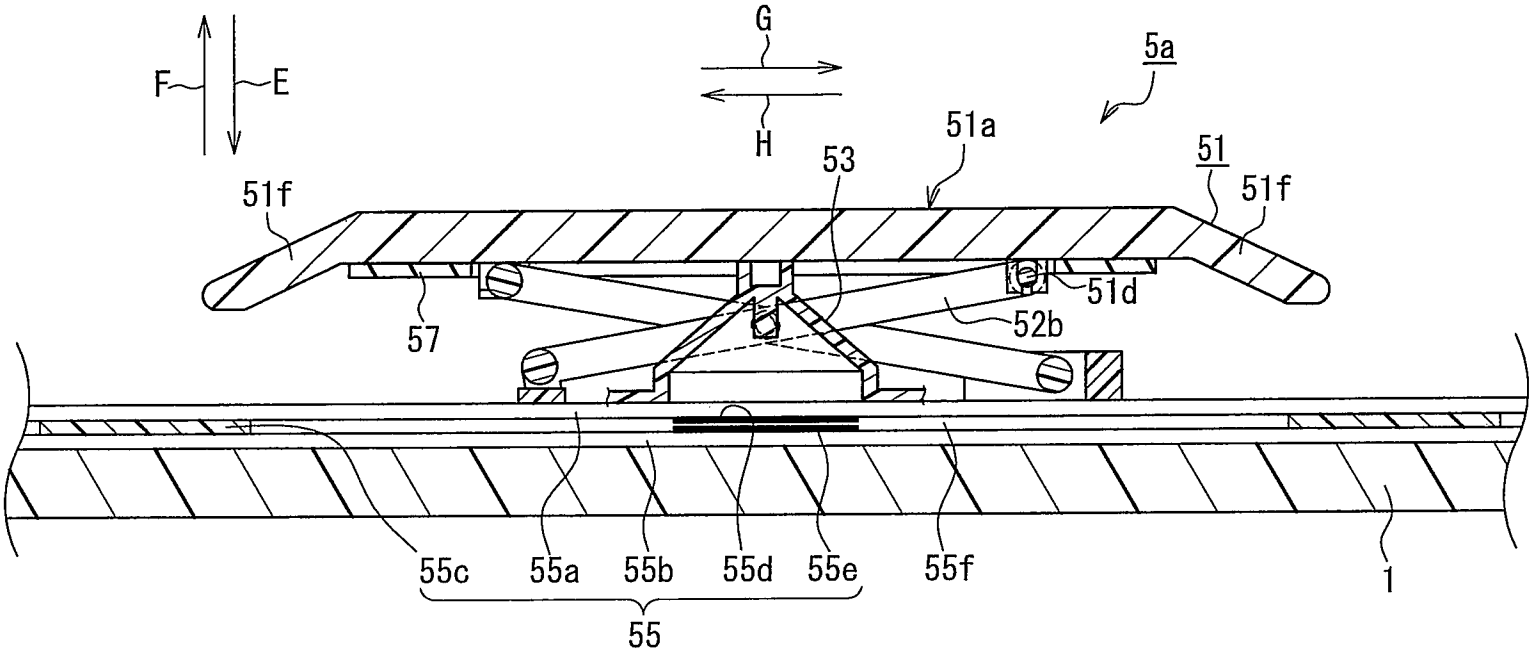
FIG. 16 is a cross-sectional view illustrating the configuration of Variation 3 of the key.

FIG. 15 is a plan view of the key 5*a* of the keyboard 5 according to Variation 3 as seen from the bottom. FIG. 16 is a cross-sectional view of portion Z-Z of the keyboard 5 in FIG. 15.

The resilient sheet 57 is arranged between the bottom surface 51*e* of the key top 51 and one end of the first link member 52*a*, as well as between the bottom surface 51*e* of the key top 51 and one end of the second link member 52*b*. The resilient sheet 57 is formed from a sheet of resilient material. The resilient sheet 57 is formed from a material that is capable of absorbing the impacts produced by the collision of the first link member 52*a* and the second link member 52*b* and thus abates the collision noise. For example, it can be formed from silicone rubber.

Since the first link member 52*a* and the second link member 52*b* abut the bottom surface 51*e*, the surface of the resilient sheet 57 on the side facing the first link member 52*a* and the second link member 52*b* is preferably formed from a material with excellent slipperiness in order to avoid hindering to the pivoting action of the first link member 52*a* and the second link member 52*b*.

The resilient sheet 57 is bonded to bottom surface 51*e* of the key top 51 using, for example, an adhesive agent. It should be noted that the resilient sheet 57 does not have to be bonded to the key top 51 with an adhesive agent, and it is possible to use a configuration in which it is secured to the key top 51 by means of a pawl engagement and the like, or even a configuration in which it is sandwiched by the key top 51 and by the first link member 52*a* and the second link member 52*b*. In addition, it is sufficient to place the resilient sheet 57 in a position on the bottom surface 51*e* of the key top 51 that is abuttable by at least the first link member 52*a* and the second link member 52*b*. In addition, providing the resilient sheet 57 in a location that is abuttable by the slanted portion 53*d* when the slanted portion 53*d* of the resilient member 53 undergoes buckling deformation is desirable because this enhances the effect of key impact noise abatement even more.

Since it is necessary for the first link member 52*a* and the second link member 52*b* to perform pivoting action when the key top 51 is lifted and lowered, a small gap (clearance) is provided intentionally between the first link support portion 51*c* and one end of first link member 52*a*, as well as between the second link support portion 51*d* and one of the second link member 52*b*. Accordingly, when the key top 51 is depressed in the raised position, as well as when the finger is moved away from the key top 51 in the lowered position and the key top 51 is caused to move to the raised position, the bottom surface 51*e* of the key top 51 may collide with one end of the first link member 52*a* and one end of the second link member 52*b*, thereby generating a collision sound.

Accordingly, as shown in FIG. 15 and FIG. 16, as a result of providing the resilient sheet 57 between the key top 51, the first link member 52*a*, and the second link member 52*b*, the first link member 52*a* and the second link member 52*b* can be made to collide with the resilient sheet 57 when the key top 51 is depressed in the raised position, as well as when the finger is removed from the key top 51 in the lowered position, causing the key top 51 *t* move to the raised position. It should be noted that the term "collision" also includes configurations, in which the first link member 52*a* and the second link member 52*b* abut the bottom surface 51*e* under inertial forces when the finger is removed from the key top 51 in the lowered position, causing it to move to the raised position. In addition, arranging the resilient sheet 57 for use with large-sized keys, e.g. the ENTER key 5*b*, the Space key 5*c*, and the like is preferable because of the more pronounced effects. Since the resilient sheet 57 is formed from a material of low hardness, such as silicone rubber and the like, the collision noise produced upon collision with the first link member 52*a* and the second link member 52*b* is quiet. Accordingly, the key impact noise produced when the key top 51 travels up and down can be abated.

The resilient sheet 57 is an example of a second sound dampening member.

This application is useful in an electronic apparatus equipped with an input device.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electronic apparatus comprising:

a key top;

a lifting/lowering mechanism supporting the key top for free up-and-down motion between a raised position and a lowered position;

a contact portion that effects switching in conjunction with the up-and-down action of the key top;

a resilient member that, along with being capable of causing the key top to remain on standby in the raised position, can be resiliently deformed during the downward travel of the key top;

a substrate that, along with supporting the lifting/lowering mechanism, has the resilient member disposed thereon, and a first sound dampening member arranged on the surface of the substrate where the lifting/lowering mechanism is provided, and abuttable by an edge of the key top when the key top is at the lowered position, wherein the first sound dampening member is formed from a resiliently deformable material and has an opening at a position corresponding to the key top, and the opening extends to a position outside of the key top in aplanar view so that a space under the key top and a space outside the key top communicate with each other when the key top is at the lowered position.

2. The electronic apparatus according to claim 1, further comprising a second sound dampening member arranged on the surface where the lifting/lowering mechanism is provided in the key top, wherein the second sound dampening member is arranged in a position abuttable by at least a portion of the lifting/lowering mechanism when the key top is the raised position.

3. The electronic apparatus according to claim 2, wherein the second sound dampening member is formed from a resiliently deformable material.

4. The electronic apparatus according to claim 1, wherein the edge of the key top is protruding downwardly toward the substrate.

* * * * *